US008590300B2

(12) United States Patent
Beale et al.

(10) Patent No.: US 8,590,300 B2
(45) Date of Patent: Nov. 26, 2013

(54) BALANCED MULTIPLE GROUPINGS OF BETA STIRLING MACHINES

(75) Inventors: William T. Beale, Athens, OH (US); James Gary Wood, Albany, OH (US)

(73) Assignee: Sunpower, Inc., Athens, OH (US)

( * ) Notice: Subject to any disclaimer, the term of this patent is extended or adjusted under 35 U.S.C. 154(b) by 930 days.

(21) Appl. No.: 12/581,346

(22) Filed: Oct. 19, 2009

(65) Prior Publication Data

US 2010/0095668 A1 Apr. 22, 2010

Related U.S. Application Data

(60) Provisional application No. 61/106,647, filed on Oct. 20, 2008, provisional application No. 61/116,477, filed on Nov. 20, 2008.

(51) Int. Cl.
*F01B 29/10* (2006.01)

(52) U.S. Cl.
USPC ..... 60/520; 60/525

(58) Field of Classification Search
USPC ..... 60/517, 525, 520
See application file for complete search history.

(56) References Cited

U.S. PATENT DOCUMENTS

| | | | | | |
|---|---|---|---|---|---|
| 4,476,681 | A * | 10/1984 | Dineen | ..... | 60/486 |
| 5,146,750 | A * | 9/1992 | Moscrip | ..... | 60/517 |
| 5,456,076 | A * | 10/1995 | Zornes | ..... | 60/525 |
| 2003/0074897 | A1 * | 4/2003 | Rollston | ..... | 60/517 |

* cited by examiner

*Primary Examiner* — Hoang Nguyen
(74) *Attorney, Agent, or Firm* — Frank H. Foster; Kremblas & Foster

(57) ABSTRACT

Multiple free-piston Stirling (FPS) machines are arranged in a group and connected for preventing or minimizing vibration. A first set of identical beta FPS machines are arranged in a mechanically co-directional orientation and configured to reciprocate in thermodynamically synchronous reciprocation with each other. The first set has axes of reciprocation intersecting a first point. A second set of beta FPS machines are arranged in a mechanically co-directional orientation that is the same as the mechanical orientation of the first set of beta FPS machines and are configured to reciprocate in thermodynamically synchronous reciprocation with each other but in thermodynamically opposed reciprocation to the first set. The FPS machines of the second set are identical to the FPS machines of the first set and have axes of reciprocation intersecting a point, which may be a point at infinity.

9 Claims, 8 Drawing Sheets

Fig. 8
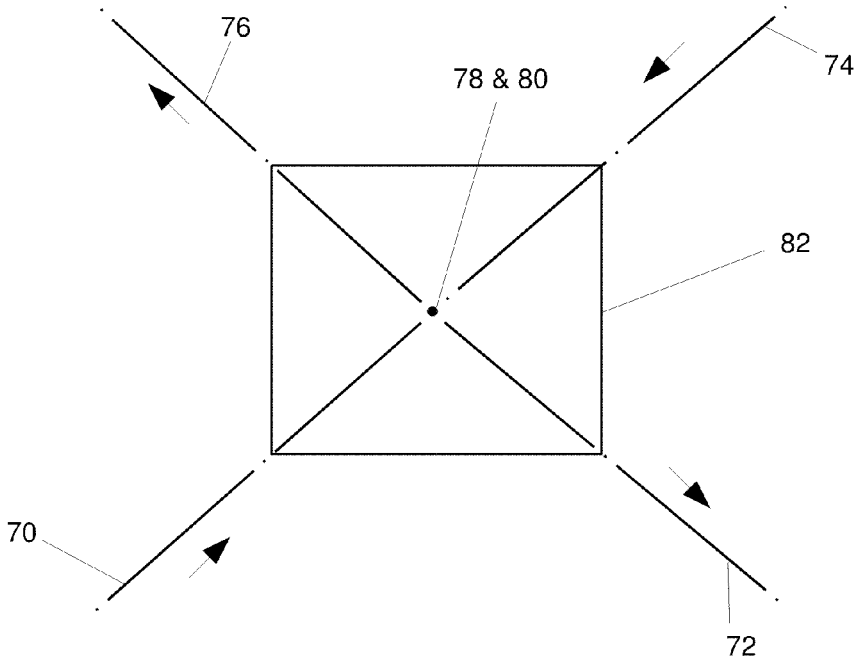
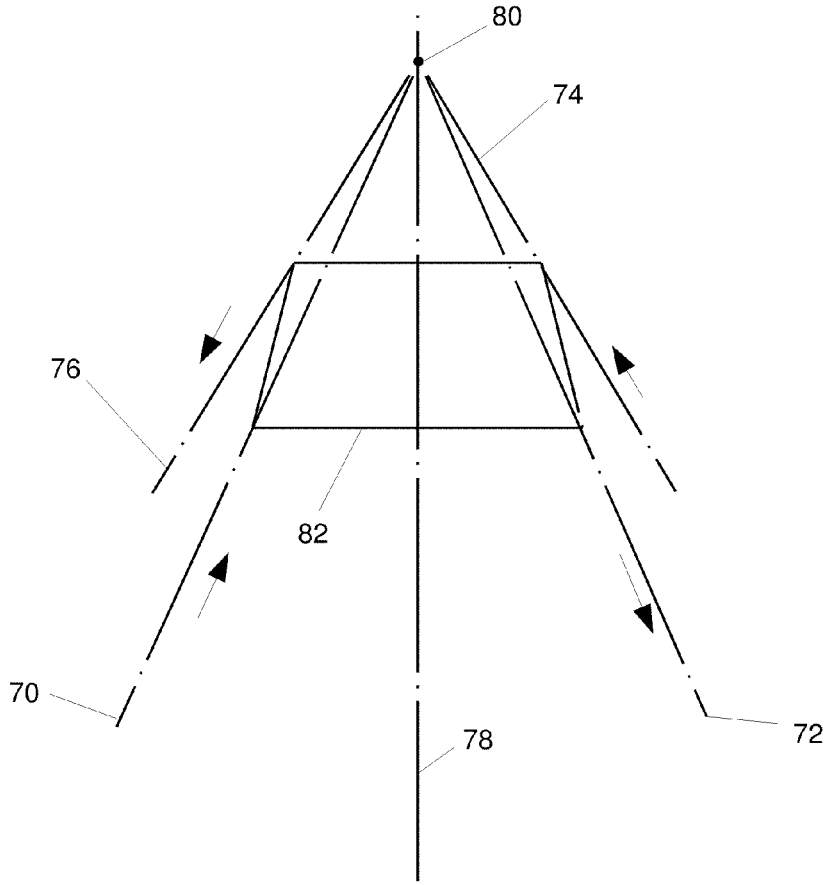
Fig. 9

BALANCED MULTIPLE GROUPINGS OF BETA STIRLING MACHINES

CROSS-REFERENCES TO RELATED APPLICATIONS

This application claims the benefit of U.S. Provisional Application No. 61/106,647 filed 20 Oct. 2008 U.S. Provisional Application No. 61/116,477 filed 20 Nov. 2008. The above prior applications are hereby incorporated by reference.

STATEMENT REGARDING FEDERALLY-SPONSORED RESEARCH AND DEVELOPMENT (Not Applicable)

REFERENCE TO AN APPENDIX (Not Applicable)

BACKGROUND OF THE INVENTION

1. Field of the Invention

This invention relates generally to Stirling cycle machines and more particularly to groups of beta free piston Stirling cycle engines and beta free piston Stirling cycle coolers that are balanced to prevent or minimize vibration.

2. Description of the Related Art

Stirling machines have been known for nearly two centuries but in recent decades have been the subject of considerable development because they offer important advantages. Modern versions have been used as engines and heat pumps for many years in a variety of applications. In a Stirling machine of the type used in the invention, a working gas is confined in a working space comprised of an expansion space and a compression space. The working gas is alternately expanded and compressed in order to either do work or to pump heat. Each Stirling machine has a pair of pistons, one referred to as a displacer and the other referred to as a power piston and often just as a piston. The reciprocating displacer cyclically shuttles a working gas between the compression space and the expansion space which are connected in fluid communication through a heat accepter, a regenerator and a heat rejecter. The shuttling cyclically changes the relative proportion of working gas in each space. Gas that is in the expansion space, and/or gas that is flowing into the expansion space through a heat exchanger (the accepter) between the regenerator and the expansion space, accepts heat from surrounding surfaces. Gas that is in the compression space, and/or gas that is flowing into the compression space through a heat exchanger (the rejecter) between the regenerator and the compression space, rejects heat to surrounding surfaces. The gas pressure is essentially the same in both spaces at any instant of time because the spaces are interconnected through a path having a relatively low flow resistance. However, the pressure of the working gas in the work space as a whole varies cyclically and periodically. When most of the working gas is in the compression space, heat is rejected from the gas. When most of the working gas is in the expansion space, the gas accepts heat. This is true whether the machine is working as a heat pump or as an engine. The only requirement to differentiate between work produced or heat pumped, is the temperature at which the expansion process is carried out. If this expansion process temperature is higher than the temperature of the compression space, then the machine is inclined to produce work so it can function as an engine and if this expansion process temperature is lower than the compression space temperature, then the machine will pump heat from a cold source to a warm heat sink.

Stirling machines can therefore be designed to use the above principles to provide either: (1) an engine having a piston and displacer driven by applying an external source of heat energy to the expansion space and transferring heat away from the compression space and therefore capable of being a prime mover for a mechanical load, or (2) a heat pump having the power piston (and sometimes the displacer) cyclically driven by a prime mover for pumping heat from the expansion space to the compression space and therefore capable of pumping heat energy from cooler mass to a warmer mass. The heat pump mode permits Stirling machines to be used for cooling an object in thermal connection to its expansion space, including to cryogenic temperatures, or heating an object, such as a home heating heat exchanger, in thermal connection to its compression space. Therefore, the term Stirling "machine" is used to generically include both Stirling engines and Stirling heat pumps.

Until about 1965, Stirling machines were constructed as kinematically driven machines meaning that the piston and displacer are connected to each other by a mechanical linkage, typically connecting rods and crankshafts. The free piston Stirling machine was then invented by William Beale. In the free piston Stirling machine, the pistons are not connected to a mechanical drive linkage. A free-piston Stirling machine is a thermo-mechanical oscillator and one of its pistons, the displacer, is driven by the working gas pressure variations and differences in spaces or chambers in the machine. The other piston, the power piston, is either driven by a reciprocating prime mover when the Stirling machine is operated in its heat pumping mode or drives a reciprocating mechanical load when the Stirling machine is operated as an engine. Free piston Stirling machines offer numerous advantages including the ability to control their frequency, phase and amplitude, the ability to be hermetically sealed from their surroundings and their lack of a requirement for a mechanical fluid seal between moving parts to prevent the mixing of the working gas and lubricating oil.

Because free-piston Stirling machines can be constructed and operated as an engine, such engines have been linked as a prime mover to a variety of mechanical loads. These loads include linear electric alternators, compressors and fluid pumps and even Stirling heat pumps. Similarly, because free-piston Stirling machines can be operated in a heat pump mode, they have been driven as a load by a variety of prime movers, including linear motors.

Consequently, a Stirling machine, like a linear motor or alternator, are energy transducers that can each be operated in either of two modes. A Stirling machine can be driven mechanically in reciprocation by a prime mover to pump heat from a lower temperature mass to a higher temperature mass. A Stirling machine can be driven by the energy of the temperature difference between two masses and provide an output of mechanical reciprocation. Similarly, a linear motor or alternator structure can be mechanically driven in reciprocation by a prime mover to generate electrical power output or a linear motor/alternator be driven by a source of alternating electrical power to operate as a motor providing a mechanical reciprocating output. Therefore, a Stirling machine operating as an engine can be used to drive a linear alternator and a linear motor can be used to drive a Stirling machine operating in a heat pumping mode. In both of these cases, the power piston of the Stirling machine is ordinarily directly connected to the reciprocating member of the linear motor or alternator so that they reciprocate as a unit.

Stirling machine have been developed in a variety of configurations. A common form of the modern Stirling engine is the alpha configuration, also referred to as the Rinia, Siemens or double acting arrangements. A second Stirling configuration is the beta Stirling configuration characterized by a displacer and piston in the same cylinder. The third is the gamma Stirling configuration characterized by locating the displacer and piston in different cylinders. The present invention deals with beta configuration, free-piston Stirling machines.

Beta FPS machines have reciprocating masses which are principally the power piston, the displacer and structures attached to each of them that reciprocate with each of them. Consequently, there are two reciprocating composite masses in a beta FPS machine that reciprocate along the axis out of phase with each other. The masses are the composite mass of the piston together with structures that are fixed to the piston and therefore reciprocate with the piston and the composite mass of the displacer together with structures that are fixed to the displacer and therefore reciprocate with the displacer. The oscillating acceleration and deceleration of the composite masses of each machine create an axial force (F=ma) alternating between opposite axial directions. These axially alternating forces cause axially oscillating vibration. Because the two composite masses reciprocate along the same axis, they create a resultant axial force alternating between opposite axial directions. Because a resultant axial force is created, for purposes of the explanation of the present invention and discussion of the invention, a FPS machine can be thought of as simply a machine having a single resultant mass reciprocating inside it and along a longitudinal axis. For that reason, FPS machines can be and are symbolically illustrated as a simple cylindrical body with the resultant axial force of each FPS machine resulting in vibration forces causing vibration which is often considerable.

FIGS. 3 and 4 illustrate prior art beta FPS machines. FIG. 3 diagrammatically illustrates a single beta FPS machine 10 with an axis 12 of reciprocation. The phase of its composite, resultant vibration force can be illustrated by an arrow and/or + or − symbols for purposes, in some situations, of comparison to the phase of other FPS machines.

In the prior art it is known that a pair of two identical beta FPS machines can be positioned coaxially (coaxial axes of reciprocation) in an end to end relationship although they can have space between the ends. This prior art arrangement is illustrated in FIG. 4. There are two identical FPS machines 14 and 16 mounted coaxially along a common axis 18. The two machines 14 and 16 are physically oriented so they are in a mechanically opposed orientation, but they are operated thermodynamically in phase. Because they are mechanically opposed, the expansion spaces or alternatively the compression spaces of both are near (proximal) the center of this arrangement. The other space of each is at the opposite ends.

Because the FPS machines are mechanically opposed but operated thermodynamically in phase, the reciprocating masses of each machine move in the opposite direction from the corresponding masses of the other machine. Therefore, the resultant vibration forces of each machine are equal and opposite and cancel to eliminate or at least minimize net vibration. Of course multiple replications of this arrangement can be combined and also provide a balanced group.

There are several ways known in the prior art for controlling the relative thermodynamic phasing of two or more associated FPS machines. The relative phasing of their operation is controlled by their physical connections and structural characteristics. A simple example known in the prior art is that each FPS machines can be an engine connected to drive a linear alternator. Connecting such alternators together in the same polarity, forces the FPS engines to run in phase. Connecting such alternators together in opposite polarity forces the FPS engines to run in anti-phase. Therefore, for a group of 4 machines, all four linear alternators can be electrically connected together in parallel with two connected at the same polarity and the other two connected at a polarity opposite to the first two. Similarly, for a group of 6 machines, three may be connected in one polarity and three in the opposite polarity giving the result that the three FPS machines of each subgroup will run in phase with each other and in anti-phase to the other three FPS machines of the other subgroup. The same parallel connection for forcing phase relationships can be accomplished with linear motors driving FPS coolers. Other prior art means for forcing the two FPS machines to operate at a selected phase relationship include fluid couplings and thermodynamic cycle couplings. A connection from the inner end of one acceptor to the opposite engine's expansion space in an opposed pair forces the desired equal motions of displacers that uses the gas cycle as a forcing link. The gas from the acceptor of one engine must go to the other engine's expansion space. Two beta FPS machines can be forced to run in phase by connecting their expansion spaces together by a tube or passageway.

Consequently, the thermodynamic phase of operation of two or three beta FPS machines is not merely their manner of operating. It is the result of their structure and connection as known in the prior art. This is like a storage battery in the sense that the polarity of a storage battery, which determines the direction it pushes electrons through the external circuit, is not merely its manner of operation but rather is a characteristic of the machine that is a result of its structure, including its chemical structure. Because the structural characteristics of beta FPS machines that determine the relative thermodynamic phase of their operation is known in the prior art, it is not further described. The thermodynamic phase of each FPS machine may be viewed as and indicated by a polarity.

As described above and known in the prior art, an arrangement of two coaxially positioned beta FPS machines that are in a mechanically opposed orientation and operating in thermodynamically synchronous phase cancels vibration forces. However, if two beta FPS machines are not positioned coaxially, they either form a couple or they have a net translational vibration force. A couple is two parallel forces that are equal in magnitude but opposite in direction. A couple applies a torque to the entire composite mass of the machines which results in a vibrational torque.

The problem with FPS machines that are on non-coaxial axes of reciprocation is illustrated in FIGS. 15-18 for parallel axes of reciprocation. When the axes are neither parallel nor coaxial, the problem is made more complicated by the effect of the oblique resultants of the net vibrational forces and couples. In FIGS. 15-18 the E and C represent the expansion space end and the compression space end of the beta FPS machines and therefore represent the mechanical orientation of the machines. Referring to FIG. 15, if the axes of two parallel FPS machines are in a mechanically opposed orientation, and are operated in thermodynamically opposite reciprocation, their reciprocating masses move in mechanical synchronism and therefore they have a net vibrational translation force. Referring to FIG. 16, if the axes of two parallel FPS machines are in a mechanically opposed orientation, and are operated in thermodynamically synchronous reciprocation, their reciprocating masses move in mechanically opposed directions and they have a net vibrational couple and therefore a net vibrational torque. Referring to FIG. 17, if the axes of two parallel FPS machines are in a mechanically co-directional orientation, and are operated in thermodynamically opposite reciprocation, their reciprocating masses move in mechanically opposed directions and they have a net vibrational couple and therefore a net vibrational torque. Referring to FIG. 18, if the axes of two parallel FPS machines are in a mechanically co-directional orientation, and are operated in thermodynamically synchronous reciprocation, their reciprocating masses move in mechanical synchronism and therefore they have a net vibrational translation force.

The main purpose of the invention is to position and orient each beta, free piston Stirling machine of a group of beta, free piston Stirling machines in arrangements other than end to end coaxially and still cancel all the vibration forces and vibration torques that result from the acceleration and deceleration of their internal reciprocating masses. In other words, the sum of all acceleration forces (F=ma) from all reciprocating components and the sum of all couples (torque) both sum to zero. The arrangements that embody the invention provide groups of beta FPS machines that have a different aspect ratio than the long thin arrangement that characterizes the end to end coaxial arrangement while still canceling all force and torque vibrations. Different aspect ratios are preferred for different applications or implementations of FPS machines. For some applications or implementations of multiple FPS machines, it is desirable to have the machines in a long thin arrangement. For those applications, the prior art arrangement for canceling vibration forces is preferred. However, for some applications it is desirable to have an arrangement in which the FPS machines are more nearly or completely side by side so that the arrangement is more compact and not long and thin.

Another advantage of the present invention is that, unlike the end to end coaxial arrangements of the prior art, arrangements that embody the invention also allow the hot ends and/or the cold ends of such machines to be placed in nearby adjacent or laterally spaced positions. For example, the ends that accept heat can be conveniently located near the source of heat and/or the heat rejecting ends can be located near a heat sink. An example of this location of the respective ends is true for the examples of FIGS. 17 and 18, although they are not balanced because they do not embody the invention.

Yet another advantage of the present invention arises because the inventors believe that in the future, for some applications, multiple smaller beta FPS machines in a group will be a preferable implementation than a single or a few larger machines. Smaller machines are much less expensive to construct. Therefore, in some cases, economies of scale and mass production are likely to give a lower cost final product when comprised of multiple smaller machines.

BRIEF SUMMARY OF THE INVENTION

The invention is a group of multiple free-piston Stirling (FPS) machines arranged and connected for preventing or minimizing vibration. Each FPS machine has an outer housing and internal reciprocating composite masses, including the masses of a prime mover or load connected to the FPS machine. A first set of identical beta FPS machines is rigidly connected together, arranged in a mechanically co-directional orientation and configured to reciprocate in thermodynamically synchronous reciprocation with each other. The first FPS machines have axes of reciprocation that intersect a first point, which may be a point at infinity. The axes of the first FPS machines make the same angle with a central axis of motion and are equi-angularly spaced around that central axis. A second set of beta FPS machines are rigidly connected together and rigidly connected to the first set of machines. The second set of machines is arranged in a mechanically co-directional orientation that is the same as the mechanical orientation of the first set of beta FPS machines. The second set of machines is configured to reciprocate in thermodynamically synchronous reciprocation with each other but in thermodynamically opposed reciprocation to the machines of the first set. The FPS machines of the second set are identical to the FPS machines of the first set and have axes of reciprocation intersecting a point, which may be a point at infinity. The axes of the second FPS machines all make the same angle with the central axis of motion. The axes of the second FPS machines are also equi-angularly spaced around the central axis of motion.

One kind of group is referred to as a quad and may alternatively be described in the following manner. The quad has a first opposed pair of identical beta FPS machines configured to reciprocate in anti-phase with each other. The first opposed pair of FPS machines have axes of reciprocation in a first plane, the axes intersecting a point which can be a point at infinity or a point a finite distance from the machines. The quad also has a second opposed pair of beta FPS machines configured to reciprocate in anti-phase with each other. The FPS machines of the second pair are identical to the FPS machines of the first pair and have axes of reciprocation in a second plane, the axes intersecting the same point. All the FPS machines are rigidly connected together and each FPS machine is configured and oriented on its axis for operating in phase with the diagonally opposite FPS machine.

Another kind of group is referred to as a hex and may alternatively be described in the following manner. The hex arrangement has a first triad of three identical beta FPS machines rigidly connected together and configured to reciprocate in phase with each other. The FPS machines of the first triad have axes of reciprocation that intersect a point which can be a point at infinity or a point a finite distance from the machines. The axes of the first triad are positioned at the apexes of a first equilateral triangle in a base plane that makes the same angle with each axis of reciprocation. The hex arrangement also has a second opposed triad of three FPS machines that are identical to the machines of the first triad. The second triad is rigidly connected to the machines of the first triad and are configured to reciprocate in anti-phase with the machines of the first triad. The FPS machines of the second triad have their axes of reciprocation intersecting the same point. The axes of reciprocation of the second triad are positioned at the apexes of a second equilateral triangle in the base plane. The first equilateral triangle and the second equilateral triangle are concentric and have sides of identical length. However, the equilateral triangles are angularly offset from each other so peripheral lines joining the apexes of the first and second equilateral triangles form a regular hexagon.

BRIEF DESCRIPTION OF THE SEVERAL VIEWS OF THE DRAWINGS

FIG. 8 is a diagrammatic top view illustrating an alternative quad embodiment of the invention.

FIG. 9 is a diagrammatic side view of the embodiment illustrated in FIG. 8.

Figure 1:
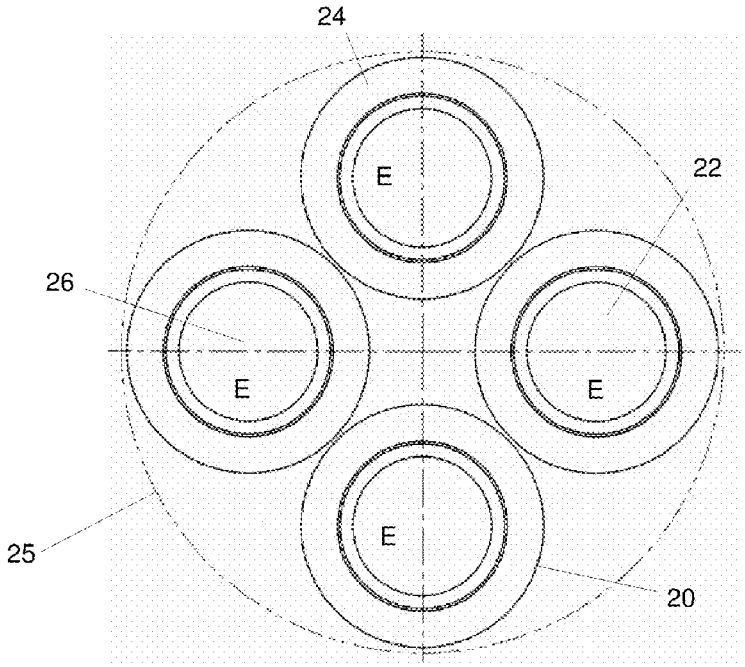
FIG. 1 is a top view of a quad embodiment of the invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

Provisional patent application Ser. No. 61/106,647 and Ser. No. 61/116,477 are hereby incorporated by reference into this application.

Definition of Terms

In describing the invention and its embodiments, there are terms used that are desirably defined and therefore the following definitions are stated.

FPS—an abbreviation for free piston Stirling.

Beta FPS machine—one beta Free piston Stirling engine or one beta free piston Stirling cooler. A beta FPS machine has a housing, a reciprocating power piston and a reciprocating displacer. They are well known in the prior art and groupings of them are the subject of this invention.

Balanced group of FPS machines—multiple, rigidly connected beta FPS machines for which the sum of their translational force vectors and the sum of their couples (torque vectors), both resulting from the acceleration (F=ma) forces of their reciprocating pistons, displacers and masses attached to them, both sum to zero.

Thermodynamically synchronous or thermodynamically opposed operation—Multiple beta FPS machines are in thermodynamically synchronous operation when phasor diagrams of the motion of their masses and the working gas are identical if both machines have the same reference, such as the piston being at its furthest travel toward the expansion space. Multiple beta FPS machines are thermodynamically opposed (i.e. in thermodynamic anti-phase) when the phasor diagrams of the motion of their masses and the working gas are 180° out of phase with respect to the same reference. Stated another way, beta FPS machines are in thermodynamic synchronous operation if their pistons are at top-dead-center at the same time and they are in thermodynamic opposed operation if the piston of one is at top-dead-center when the piston of the other is at bottom-dead-center (their thermodynamic cycles are 180° out of phase).

Mechanically opposed or mechanically co-directional orientation—A beta FPS machine has an expansion space at one end and a compression space at the opposite end. Two beta FPS machines can be oriented with respect to each other so they are mechanically opposed or mechanically co-directional. Two beta FPS machines have a mechanically opposed orientation when they are arranged with their spaces being oppositely directed. For example they are in an opposed orientation if one machine has its expansion space at its top end and its compression space on the bottom end and the other machine has its compression space at its top end and its expansion space on the bottom end. Two beta FPS machines are mechanically co-directional if their spaces are similarly oriented. For example, if the machines are arranged so that both have their expansion spaces on the top and their compression spaces on the bottom, they are in a mechanically co-directional orientation.

Mechanically opposed or mechanically synchronous operation—two bodies are in mechanically opposed reciprocation when they physically move in the same cyclic manner but their motion is always in opposite directions. Phasors representing their motion in space are 180° out of phase (anti-phase). Two bodies are in mechanically synchronous operation when they physically move in the same cyclic manner and simultaneously in the same direction. Phasors representing their motion in space are in phase.

Triad—a set of three FPS machines that are arranged in accordance with the invention with two triads fixed together in accordance with the invention to form a balanced group of six machines.

Quad—a balanced group of four FPS machines arranged in accordance with the invention.

Hex—a balanced group of six FPS machine comprising two triads all arranged in accordance with the invention.

Identical FPS machines—identical means that the identical beta FPS machines are designed and constructed to operate at the same frequency and have reciprocating masses that are the same and stationary masses that are the same so that they generate the same resultant vibration forces and/or vibration torques. The same mass means that the values of the respective composite masses are the same and does not require that they have the same configuration.

The common terms of force, couple and torque are also used. The term force is used for an influence on a body that causes it to accelerate in translation. A couple is a system of two parallel forces of equal and opposite direction (or sense). A couple applies a torque to a body.

Intersection of lines at infinity—A concept that has been traditionally used in teaching physics and geometry is the concept that parallel lines may be viewed as lines that intersect a point at infinity. This concept is applicable to the present invention because one property or characteristic of the invention is that the axes of reciprocation of a set of multiple FPS machines are either parallel to each other or they intersect a common point. This property exists regardless of how far the common intersection point is removed from the machines themselves. Rather that having two independent claims that are identical except one is directed to parallel axes and the other directed to axes that intersect a point, applicant has combined these two conditions using the traditional concept that parallel is the same as intersecting a point at infinity.

The Quad Arrangement

Figure 2:
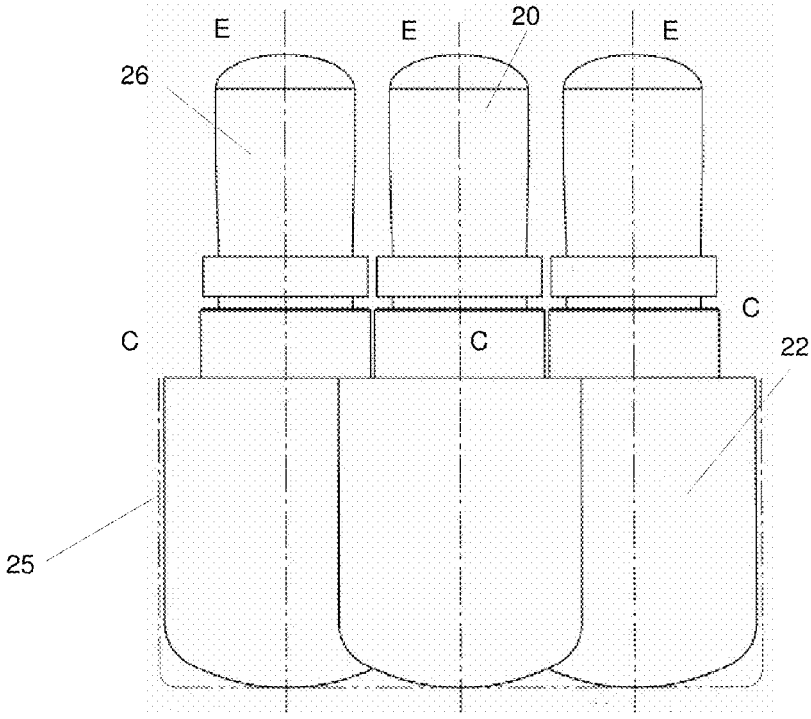
FIG. 2 is a side view of the embodiment of FIG. 1.
Figure 3:
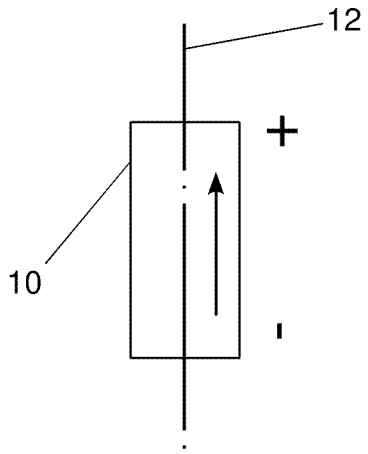
Fig. 3 Prior Art
FIG. 3 is a diagrammatic view of a single beta FPS machine as known in the prior art.
Figure 4:
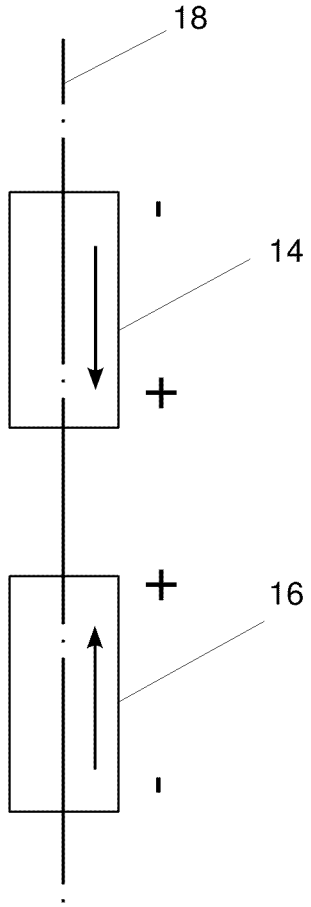
Fig. 4 Prior Art
FIG. 4 is a diagrammatic view of an opposed coaxial pair of beta FPS machines that are balanced in a manner known in the prior art.

FIGS. 1 and 2 illustrate a quad arrangement of four identical FPS machines that are balanced according to the invention. A group of four beta FPS machines 20, 22, 24 and 26 are positioned in lateral, side by side arrangement for preventing or minimizing vibration. These four machines are rigidly connected together, for example by welding them together at their periphery or more practically by bolting or welding them to a common support frame 25 in the same manner that single machines are ordinarily mounted to a support.

Figure 5:
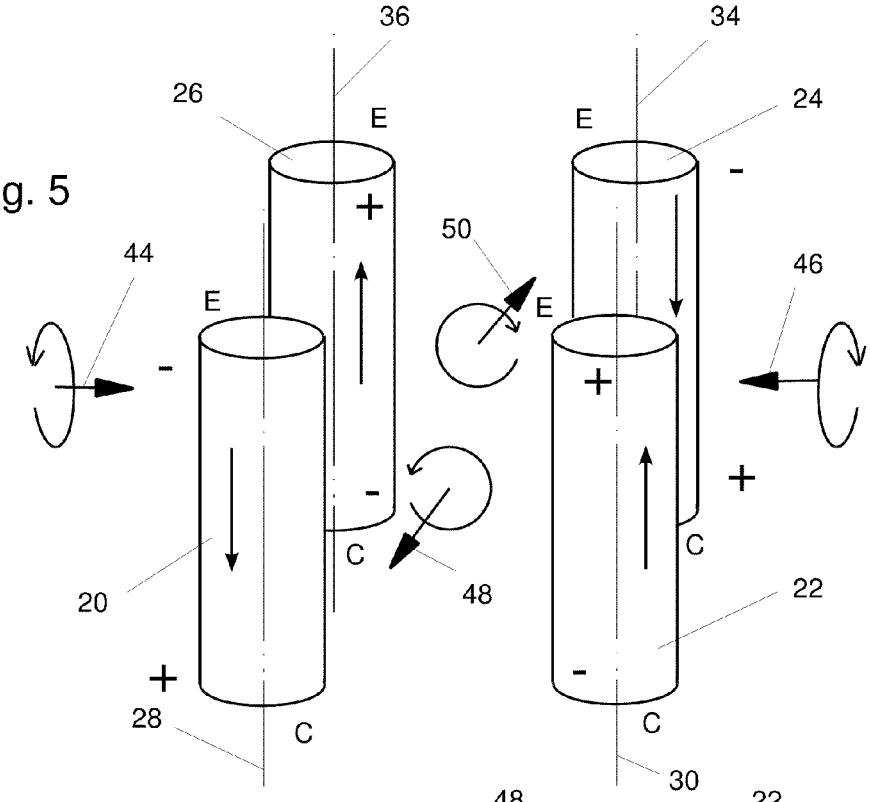
FIG. 5 is a diagrammatic front view in perspective of the embodiment of FIG. 1.
Figure 6:
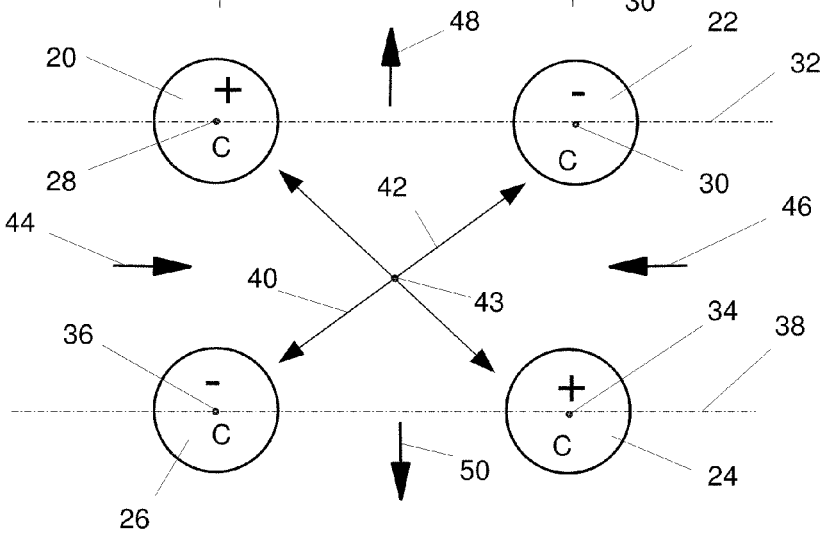
FIG. 6 is a diagrammatic bottom view of the embodiment of FIG. 5.

FIGS. 5 and 6 illustrate the same machines diagrammatically for ease of visualizing the relationships that are relevant to the invention. FIG. 6 is a bottom view of FIG. 5. As with all beta FPS machines, each machine 20, 22, 24 and 26 includes an outer housing and internal reciprocating composite masses, including the masses of a prime mover or load connected to the FPS machine.

A first set of diagonally opposite identical beta FPS machines 22 and 26 are rigidly connected together and arranged in a mechanically co-directional orientation as shown by the letters E and C. The machines 22 and 26 are configured to reciprocate in thermodynamically synchronous reciprocation with each other as illustrated by the arrows and the + and – symbols. The FPS machines 22 and 26 that form the first set have axes of reciprocation 30 and 36 intersecting a first point. In this embodiment that point is a point at infinity because the axes are all parallel to each other. The axes 30 and 36 of the first set of FPS machines make the same angle with a central axis of motion and are equi-angularly spaced around the central axis of motion. For this embodiment, the central axis of motion is a line parallel to the axes of reciprocation and intersecting two diagonals 40 and 42 that extend through the diagonally opposite axes of reciprocation of the first set and are in a plane perpendicular to the axes of reciprocation. The point of intersection is illustrated as point 43.

A second set of beta FPS machines 20 and 24 are rigidly connected together and rigidly connected to the first set of machines. The second set of machines 20 and 24 are arranged in a mechanically co-directional orientation that is the same as the mechanical orientation of the first set of beta FPS machines. In the illustrated embodiment, all the expansion space ends E are facing upwardly at the top of the machines. The second set of machines 20 and 24 is configured to reciprocate in thermodynamically synchronous reciprocation with each other but in thermodynamically opposed reciprocation to the first set of machines 22 and 26 as illustrated by the arrows and the + and – symbols. The FPS machines 20 and 24 of the second set are identical to the FPS machines of the first set and have axes of reciprocation 28 and 34 intersecting a point. In this embodiment, the point of intersection is a point at infinity because the axes are parallel. The axes of the second FPS machines all make the same angle with the same central axis of motion defined above and are equi-angularly spaced around the central axis of motion.

As described for both sets of machines, the axes of the machines of each set are equi-angularly spaced around the central axis. Because this embodiment has two machines in each set, their axes are spaced 180° about the central axis. The equiangular spacing is 360° divided by the number of machines in each set. As will be seen below, it is also possible to have a set of three machines which are spaced at 120° angular spacings around the central axis. The spacing of larger sets is determined in the same manner.

In this embodiment, as in all embodiments of the invention, it is believed to be unnecessary that the machines of a set be located at any particular position along the axes. It is believed only necessary that they be positioned so that their axes of reciprocation lie along the defined axes because the force applied by each machine as a result of the acceleration and deceleration of their reciprocating bodies act along their axes of reciprocation.

An alternative manner of describing the quad is as follows. A first opposed pair 20 and 22 of identical beta FPS machines are configured to reciprocate in anti-phase with each other as indicated by both the arrows and the + and – symbols. This first pair of FPS machines have axes of reciprocation 28 and 30 in a first plane 32. The axes in this embodiment are parallel and therefore can be thought of as intersecting at a point at infinity. A second opposed pair 24 and 26 of beta FPS machines are also configured to reciprocate in anti-phase with each other as indicated by both the arrows and the + and – symbols. The two FPS machines of the second pair are identical to the FPS machines of the first pair and have axes of reciprocation 34 and 36 in a second plane 38. The axes 34 and 36 are both parallel to the axes 28 and 30 and therefore can be thought of as intersecting the same point at infinity. In this particular embodiment, the four axes 28, 30, 34 and 36 are located at the corners of a square or a rectangle that is in a plane perpendicular to all four axes. Each of the four FPS machines is configured and oriented on its axis for operating in phase with the diagonally opposite FPS machine. The diagonal machines are indicated by the arrows 40 and 42, one set of diagonal machines being machines 20 and 24 and the other set of diagonal machines being 22 and 26.

An analysis of these four machines indicates that both the translational vibration forces and the torques from their couples cancel when summed and so the quad group of machines is balanced. The translational force vectors are symbolized by the arrow on each machine. The forces applied as a result of the reciprocation of the internal masses of the first set of machines 22 and 26 apply a resultant force along the central axis that intersects point 43. Because these machines are identical, have a co-directional orientation and operate in a thermodynamically synchronous manner, they exert equal forces which sum at the central axis but they do not exert a couple. The forces applied as a result of the reciprocation of the internal masses of the second set of machines 20 and 24 also apply a resultant force along the central axis that intersects point 43. The forces of the machines of the second set are also equal and therefore apply no torque. Furthermore, because the machines of the first set are identical to the machines of the second set, the resultant of the force of the first set is equal in magnitude to the resultant of the force of the second set. Because the resultants of the first set and the second set are equal in magnitude, are applied along the central axis but are in the opposite direction, those resultant forces cancel. Consequently, there is no net force and no net torque.

The fact of balance may alternatively be analyzed in terms of opposed pairs of machines as used in the alternative description of this embodiment. Because the two machines of each pair of machines operate in anti-phase, the vector sum of the translational forces of each pair cancel and therefore the translational forces of the group of four are balanced. Each pair of machines also forms a couple which exerts a vibrational torque on the rigidly connected group of four machines. These torques are illustrated by the torque vectors 44, 46, 48 and 50. The machines 20 and 22 form a couple with a torque vector 48 and the machines 24 and 26 form a couple with a torque vector 50. Similarly, the machines 20 and 26 form a couple with a torque vector 44 and the machines 22 and 24 form a couple with a torque vector 46. Because the machines operate in the phase relationships described above, are identical to each other and are positioned and oriented in the manner described above, it can be seen most clearly in FIG. 6 that the torque vectors 44 and 46, as well as the torque vectors 48 and 50, are equal in magnitude and opposite in direction and therefore sum to zero. Because the translational force vectors sum to zero and the torque vectors from the couples sum to zero, the net vibration is zero. Although imperfections in the machines and the relationships described above may result in some vibration, the net vibration is nonetheless minimized. Of course multiple groupings of balanced machines can be mounted together and also result in minimal or no vibration. For example any integral number of a balanced group can be mounted together to provide a balanced group of a greater number of machines.

Figure 7:
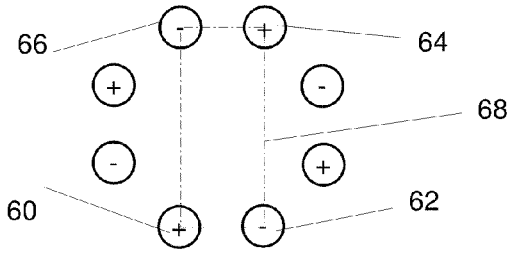
FIG. 7 is a diagrammatic view of an alternative ring arrangement of two quad arrangements of beta FPS machines.

FIG. 7 illustrates a ring arrangement of eight beta FPS machines. However, analysis shows that such an arrangement is really an arrangement of two balanced quads of the type already described. The machines 60, 62, 64 and 66 form a quad that has the characteristics of the quad of FIGS. 5 and 6. Their axes are parallel to each other and are arranged at the corners of a rectangle 68 in a plane perpendicular to their axes. The diagonally opposite machines 60 and 64 are configured to operate in phase with each other and the diagonally opposite machines 62 and 66 are also configured to operate in phase with each other. The remaining four machines illustrated in FIG. 7 are also related to each other in the same manner. They form a second quad with axes at the corners of a rectangle with the same relationships. Consequently, each subset of four machines has machines that are related in the manner described above for the quad arrangement. Therefore, the ring arrangement is an example of a manner of combining an integral multiple of four machines, each four machines in a quad arrangement in accordance with the invention. Larger integral multiples of the quad arrangement may also be used.

FIGS. 8 and 9 illustrate the arrangement of another embodiment which is a quad group of four multiple free-piston Stirling machines. FIG. 8 is a top view of FIG. 9. The machines themselves are not shown but instead only their axes of reciprocation and the polarity of their operating phases are illustrated to avoid deterioration of the clarity of the drawing. The four axes of reciprocation 70, 72, 74 and 76 lie along the surface of a cone. The cone has a central axis 78 and an apex 80. Each of the four axes of reciprocation 70, 72, 74 and 76 intersect at the cone's apex 80. Each axis of reciprocation is at the same angle with the axis of the cone, a condition which is a characteristic of the axes lying on the surface of the cone. The four axes of reciprocation 70, 72, 74 and 76 are also equi-angularly spaced around the axis of the cone. Specifically, the axes are angularly spaced at 90° intervals. The four axes intersect the corners of a square 82 that is in a base plane that makes the same angle with each of the four axes and is perpendicular to the axis 78 of the cone.

As with the quad illustrated in FIGS. 5 and 6, the quad illustrated in FIGS. 8 and 9 has a first set of identical beta FPS machines rigidly connected together, arranged in a mechanically co-directional orientation and configured to reciprocate in thermodynamically synchronous reciprocation with each other. This first set of FPS machines have axes of reciprocation 70 and 74 intersecting a first point 80 which is a finite distance from the machines. The axes 70 and 74 of the first FPS machines make the same angle with a central axis of motion 78. The axes 70 and 74 are equi-angularly spaced around the central axis of motion at an angular spacing of 180°.

A second set of beta FPS machines are rigidly connected together and rigidly connected to the first set of machines. The second set of machines are arranged in a mechanically co-directional orientation that is the same as the mechanical orientation of the first set of beta FPS machines. The second set of machines is configured to reciprocate in thermodynamically synchronous reciprocation with each other but in thermodynamically opposed reciprocation to the first set as illustrated by the arrows next to the axes. The FPS machines of the second set are identical to the FPS machines of the first set and have axes of reciprocation 72 and 76 intersecting the point 80. The axes 72 and 76 of the second FPS machines all make the same angle with the central axis of motion 78 and are equi-angularly spaced around the central axis of motion at a 180° angular spacing.

In the embodiment illustrated in FIGS. 8 and 9, all four axes of reciprocation make the same angle with the central axis 78 and therefore can be considered to lie on a cone having the point 80 at its apex. Consequently, they intersect the vertices of a square 82 in a plane perpendicular to the central axis 78. However, it is believed to be unnecessary that all four axes lie on the same cone. The axes of the first diagonally opposite machines of the first set of machines can lie on a different cone having a different apex from the cone on which the axes of the second set of machines lie. It is necessary that the axes of the first set of machines both make the same angle with the central axis and it is necessary that the axes of the second set of machines both make the same angle with the central axis. But the angle made by the axes of the first set of machines with the central axis can be different from the angle made by the axes of the second set of machines with the central axis.

A vector analysis can also be made similar to the analysis given above in connection with the description of the embodiment of FIGS. 5 and 6. However, that analysis is more complicated because there are many components of the forces and components of the torques to consider. Additionally, it would be difficult to illustrate those forces, torques and their components in three dimensions. Nonetheless, such an analysis would reveal that the group of four machines oriented, positioned and phased as described above and illustrated in FIGS. 8 and 9 are balanced.

The Hex Arrangement

Figure 10:
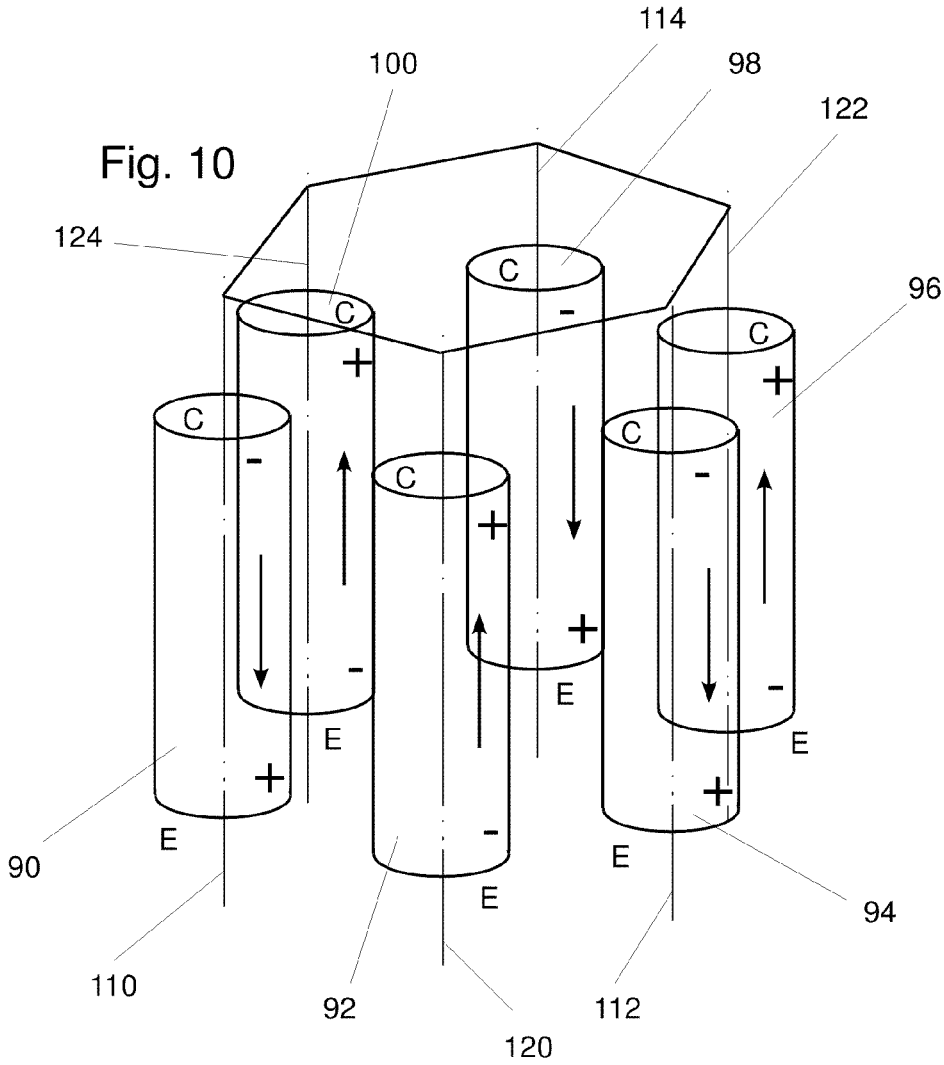
FIG. 10 is a diagrammatic view in perspective of an alternative hex arrangement of beta FPS machines in accordance with the invention.
Figure 13:
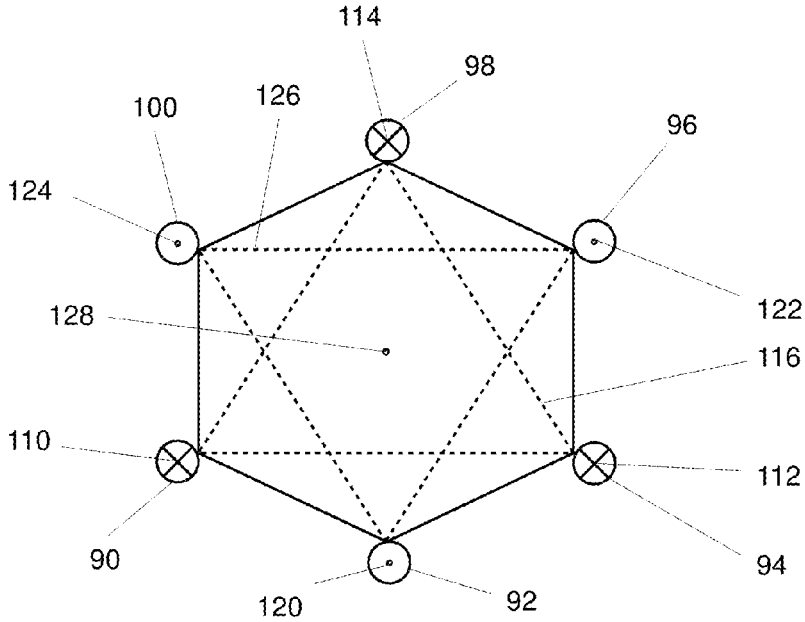
FIG. 13 is a diagrammatic view of both triads of the hex arrangement illustrated in FIG. 10.

FIGS. 10 and 13 illustrate a hex group of six identical FPS machines arranged and connected for preventing or minimizing vibration. Each FPS machine includes an outer housing and internal reciprocating composite masses, including the masses of a prime mover or load connected to the FPS machine. The hex arrangement has two sets of three machines each and therefore each set is referred to as a triad.

Figure 12:
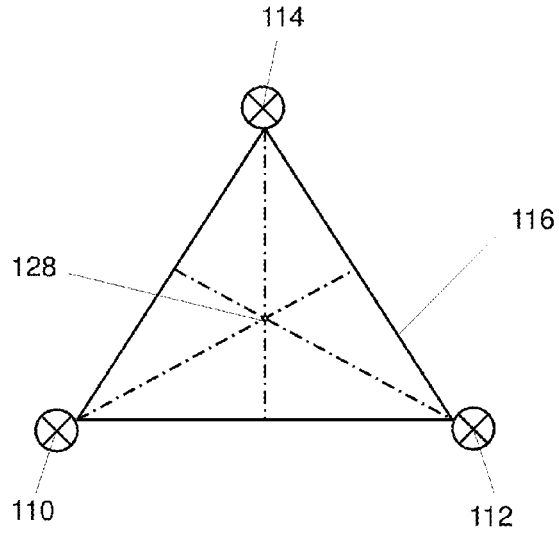
FIG. 12 is a diagrammatic view of a single triad of the hex arrangement illustrated in FIG. 10.

A first triad of three identical beta FPS machines 90, 94 and 98 are rigidly connected together, arranged in a mechanically co-directional orientation as designated by the letters E and C. The machines 90, 94 and 98 are configured to reciprocate in thermodynamically synchronous reciprocation with each other as designated by their arrow directions. The FPS machines 90, 94 and 98 of this first triad have axes of reciprocation 110, 112 and 114 respectively that intersect a point which is a point at infinity for this embodiment and therefore all the axes are parallel to each other in this embodiment. Referring to FIG. 12, the axes of reciprocation 110, 112 and 114 are positioned at (intersect) the apexes of a first equilateral triangle 116 in a base plane that makes the same angle with each axis of reciprocation. In this embodiment with parallel axes of reciprocation, the base plane is perpendicular to all the axes and therefore makes a 90° angle with each of the axes. This first triad is illustrated alone in FIG. 12 and is also included in FIG. 13. The identical thermodynamic phasing of the machines in the first triad and the identical thermodynamic phasing of the machines in a second triad are illustrated by polarity symbols in the form of arrows and + and − symbols in FIG. 10 in the same manner as in the previously described figures. In FIGS. 12 and 13, this polarity is illustrated by the traditional symbols of a dot in a circle and an X in a circle representing respectively the pointed end of an arrow and the opposite "feathered" end of an arrow.

A second set of FPS machines is formed by a second opposed triad of three FPS machines 92, 96 and 100 that are identical to the machines of the first triad. The machines 92, 96 and 100 of the second triad are rigidly connected to the machines of the first triad and are arranged in a mechanically co-directional orientation that is the same as the mechanical orientation of the first triad of machines 90, 94 and 98. The second triad of machines is configured to reciprocate in thermodynamically synchronous reciprocation with each other but in thermodynamically opposed reciprocation to the first triad. The FPS machines 92, 96 and 100 have axes of reciprocation 120, 122 and 124 that are parallel to the axes of the first triad and can be thought of as intersecting the same point at infinity that the axes of the first triad intersect. Their axes of reciprocation 120, 122 and 124 intersect the apexes of a second equilateral triangle 126 (FIG. 13) in the same base plane. The first equilateral triangle 116 and the second equilateral triangle 126 are concentric at a point 128.

The center of an equilateral triangle is illustrated in FIG. 12 as the intersection of three lines, each drawn from an apex of the triangle perpendicular to the opposite side of the triangle. The length of the sides of both equilateral triangles are identical. However, the equilateral triangles are angularly offset by 30°. Because of this angular offset, peripheral lines joining the apexes of the first and second equilateral triangles form a regular hexagon. However, the equilateral triangles may be offset by any angle and the resulting group of machines will still be balanced. Additionally, it is unnecessary that the equilateral triangles are the same size. They must be equilateral but can be of different sizes. A central axis of motion lies along a line through the concentric centers 128 of the equilateral triangles and parallel to the axes of reciprocation.

Figure 14:
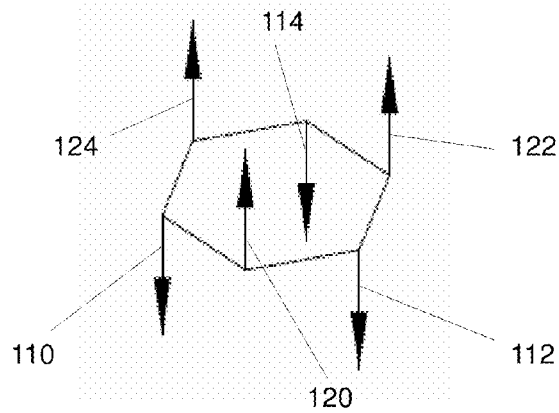
FIG. 14 is a diagrammatic view of the hex arrangement illustrated in FIG. 10.
Figure 15:
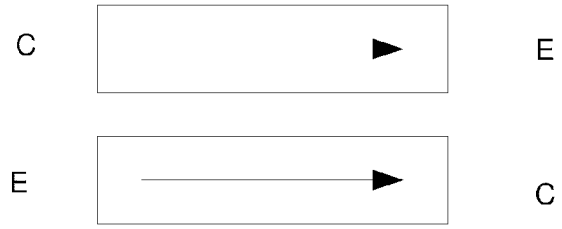
FIGS. 15-18 are diagrams illustrating the problem with vibrational forces and torques when two beta FPS machines are not positioned coaxially.
Figure 16:
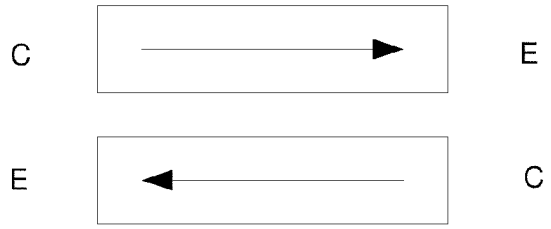
Figure 17:
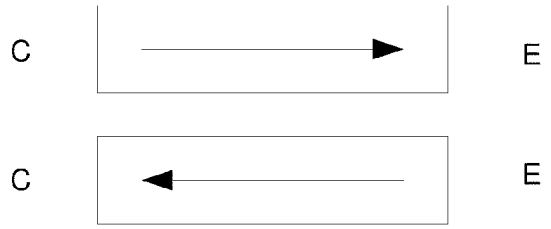
Figure 18:
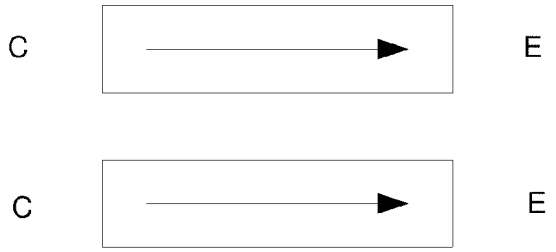

FIG. 14 is a more simple illustration of the relationships of the six beta FPS machines illustrated in FIGS. 10 and 13. The vectors of FIG. 14 show translational force vectors and therefore the thermodynamic polarity or phasing of those six machines.

The absence of any net translational force and of any net torque from a couple can most easily be observed from FIGS. 12-14. Referring first to FIG. 12, the three translational force vectors for the first triad are all along the axes 110, 112 and 114 at the apexes of the first equilateral triangle 116. Those three force vectors are all in the same direction, of equal magnitude to each other and in phase with each other. Therefore they sum to a force that is perpendicular to the plane of their equilateral triangle (the plane of the drawing) and in a direction down into that plane (in the drawing). However, because they are parallel and in the same direction they have no couple.

Similarly, the three translational force vectors for the second triad are all along the axes 120, 122 and 124 at the apexes of the second equilateral triangle 126. Those three force vectors of the second triad are all in the same direction, of equal magnitude to each other and in phase with each other. They are also of equal magnitude to the three force vectors of the first triad. Therefore they sum to a force that is perpendicular to the plane of their equilateral triangle (the plane of the drawing) but up from that plane (in the drawing). Because they too are parallel and in the same direction, they have no couple. However, the force vectors of the second triad are all in the opposite direction from the force vectors of the first triad.

So the result of these relationships is that, because all six of the machines of both the first and the second triad are identical, the sum of the three force vectors of the first triad is equal in magnitude to the sum of the three force vectors of the second triad. Because the force vectors of the first triad are equal in magnitude and opposite in direction to the force vectors of the second triad, the translational force vectors cancel. Further, the three force vectors at the apexes of an equilateral triangle are equal and in the same direction, they have a resultant force vector equal to their sum, at the center of the equilateral triangle. Because the two equilateral triangles that define the location of the axes of the two triads are concentric, the resultant force vectors of the two triads act in the opposite direction at the same point and therefore there is no couple.

Figure 11:
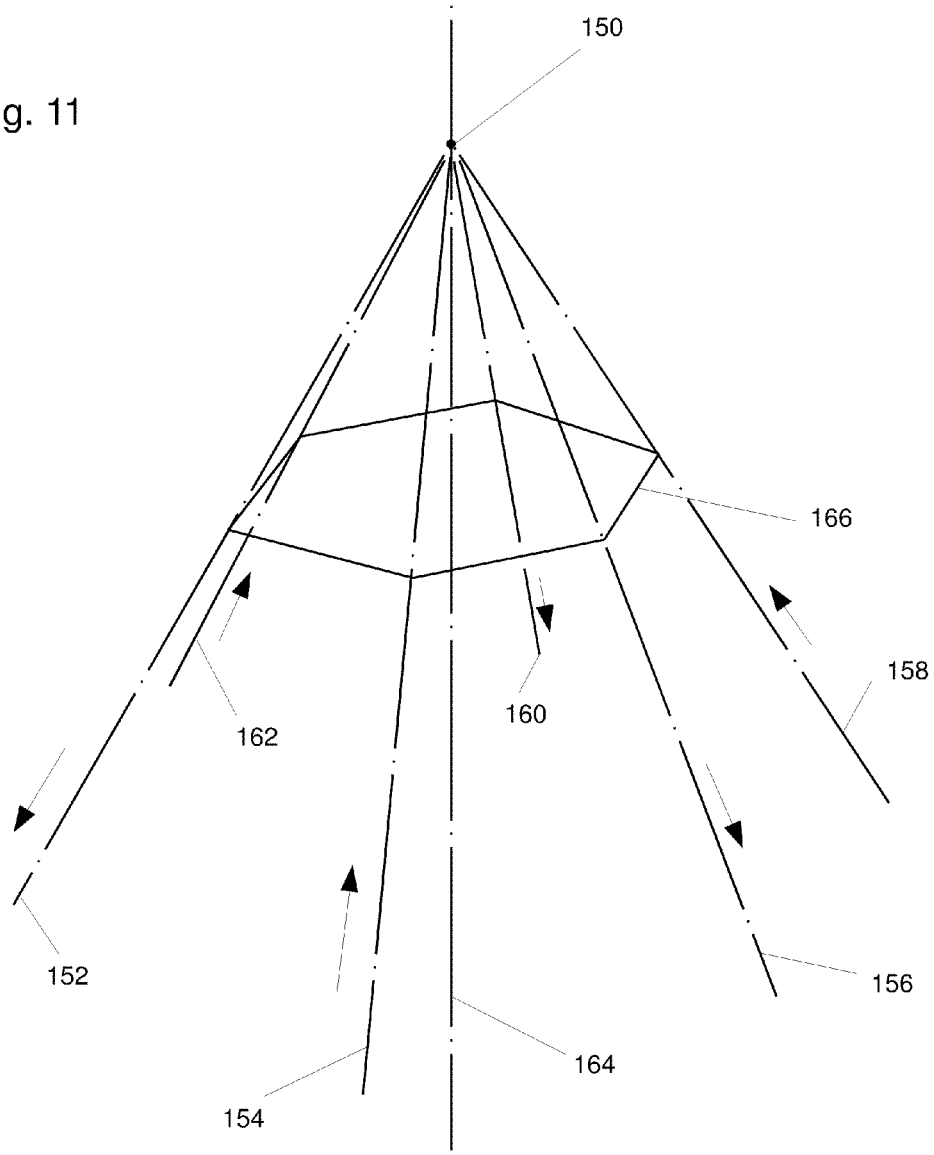
FIG. 11 is a diagrammatic view in perspective of another alternative hex arrangement of beta FPS machines in accordance with the invention.

FIG. 11 illustrates another hex embodiment. It has the same characteristics and is arranged in the manner as described for the embodiment of FIG. 10 except that the axes of reciprocation for its six machines intersect a point 150 at a finite distance from the machines. Its axes 152, 154, 156, 158, 160 and 162 all intersect the point 150. These axes lie on a cone having a central axis 164 and those axes intersect the apexes of a regular hexagon 166. The hexagon 166 is in a base plane that is perpendicular to the central axis 164 of the cone and each axis of reciprocation makes the same angle with the hexagon 166. The hexagon 166 can be analyzed as comprised of two equilateral triangles with the machines arranged as previously described. The axes 152, 156 and 160 of a first triad of FPS machines make the same angle with the central axis of motion 164 and are equi-angularly spaced around the central axis of motion 164. Similarly, the axes 154, 158 and 162 of the second triad of FPS machines all make the same angle with the central axis of motion 164 and are equi-angularly spaced around the central axis of motion 164.

It is believed unnecessary that the identical angles that the axes of reciprocation of the first triad make with the central axis 164 be identical to the identical angles that the axes of the second triad make with the central axis 164. The three axes of the first triad may lie on a different cone than the cone on which the three axes of the second triad lie. These cones may be different and their apexes may be at different locations along the central axis 164.

Combinations

Combining quads and hex arrangements results in larger groups of balanced machines having an even number of machines in a group. Table 1 shows several sized groupings for various total numbers of machines that can be combined in a group, the number of quads and hex arrangements that can be combined to give the total number and an alternative number of quad and hex arrangements that can also give the same total numbers.

TABLE 1

| Total Number of | Primary Grouping | | Alternate Grouping | |
|---|---|---|---|---|
| Machines to be Balanced | Number of Quads | Number of Hex Arrangements | Number of Quads | Number of Hex Arrangements |
| 4 | 1 | 0 | | |
| 6 | 0 | 1 | | |
| 8 | 2 | 0 | | |
| 10 | 1 | 1 | | |
| 12 | 3 | 0 | 0 | 2 |
| 14 | 2 | 1 | | |
| 16 | 4 | 0 | 1 | 2 |
| 18 | 3 | 1 | 0 | 3 |
| 20 | 5 | 0 | | |
| 22 | 4 | 1 | 1 | 3 |
| 24 | 6 | 0 | 0 | 4 |
| 26 | 5 | 1 | | |
| 28 | 7 | 0 | 1 | 4 |
| 30 | 6 | 1 | 0 | 5 |
| 32 | 8 | 0 | | |

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A group of multiple free-piston Stirling (FPS) machines arranged and connected for preventing or minimizing vibration, each FPS machine including an outer housing and internal reciprocating composite masses, including the masses of a prime mover or load connected to the FPS machine, the group comprising:

(a) a first set of identical beta FPS machines rigidly connected together, arranged in a mechanically co-directional orientation and configured to reciprocate in thermodynamically synchronous reciprocation with each other, the first FPS machines having axes of reciprocation intersecting a first point, which may be a point at infinity, the axes of the first FPS machines making the same angle with a central axis of motion and equi-angularly spaced around the central axis of motion;

(b) a second set of beta FPS machines rigidly connected together and rigidly connected to the first set of machines, the second set of machines arranged in a mechanically co-directional orientation that is the same as the mechanical orientation of the first set of beta FPS machines, the second set of machines configured to reciprocate in thermodynamically synchronous reciprocation with each other but in thermodynamically opposed reciprocation to the first set, the FPS machines of the second set being identical to the FPS machines of the first set and having axes of reciprocation intersecting a point, which may be a point at infinity, the axes of the second FPS machines all making the same angle with said central axis of motion and equi-angularly spaced around the central axis of motion; and (c) wherein each set has three FPS machines.

2. A group of multiple FPS machines in accordance with claim 1 wherein the axes of reciprocation intersect the vertices of a hexagonal polygon in a plane perpendicular to the axes of reciprocation.

3. A group of multiple free-piston Stirling (FPS) machines arranged and connected for preventing or minimizing vibration, each FPS machine including an outer housing and internal reciprocating composite masses, including the masses of a prime mover or load connected to the FPS machine, the group comprising:

(a) a first set of identical beta FPS machines rigidly connected together, arranged in a mechanically co-directional orientation and configured to reciprocate in thermodynamically synchronous reciprocation with each other, the first FPS machines having axes of reciprocation intersecting a first point, the axes of the first FPS machines making the same angle with a central axis of motion and equi-angularly spaced around the central axis of motion; and (b) a second set of beta FPS machines rigidly connected together and rigidly connected to the first set of machines, the second set of machines arranged in a mechanically co-directional orientation that is the same as the mechanical orientation of the first set of beta FPS machines, the second set of machines configured to reciprocate in thermodynamically synchronous reciprocation with each other but in thermodynamically opposed reciprocation to the first set, the FPS machines of the second set being identical to the FPS machines of the first set and having axes of reciprocation intersecting a point, the axes of the second FPS machines all making the same angle with said central axis of motion and equi-angularly spaced around the central axis of motion and (c) wherein said points are a finite distance from said machines making the axes of reciprocation of the first set lie on a first cone and the axes of reciprocation of the second set lie on a cone.

4. A group of multiple FPS machines in accordance with claim 3 wherein said points are identically positioned making said cones identical.

5. A group of multiple FPS machines in accordance with claim 4 wherein each set has two FPS machines.

6. A group of multiple FPS machines in accordance with claim 5 wherein the axes of reciprocation intersect the vertices of a square, a rectangle or a diamond in a plane perpendicular to the central axis of motion.

7. A group of multiple FPS machines in accordance with claim 6 wherein the axes of reciprocation intersect the vertices of a hexagonal polygon in a plane perpendicular to the central axis of motion.

8. A group of multiple free-piston Stirling (FPS) machines arranged and connected for preventing or minimizing vibration, each FPS machine including an outer housing and internal reciprocating composite masses, including the masses of a prime mover or load connected to the FPS machine, the group comprising:

(a) a first opposed pair of identical beta FPS machines configured to reciprocate in anti-phase with each other, the first FPS machines having axes of reciprocation in a first plane, the axes intersecting a point;

(b) a second opposed pair of beta FPS machines configured to reciprocate in anti-phase with each other, the FPS machines of the second pair being identical to the FPS machines of the first pair and having axes of reciprocation in a second plane, the axes intersecting the same point;

(c) wherein the FPS machines are rigidly connected together and each FPS machine is configured and oriented on its axis for operating in phase with the diagonally opposite FPS machine; and (d) wherein the four axes lie along the surface of a cone and intersect at the cone's apex, each axis of reciprocation being at the same angle with the axis of the cone, the axes being equi-angularly spaced around the axis of the cone.

9. A group of multiple free-piston Stirling (FPS) machines arranged and connected for preventing or minimizing vibration, each FPS machine including an outer housing and internal reciprocating composite masses, including the masses of a prime mover or load connected to the FPS machine, the group comprising:

(a) a first triad of three identical beta FPS machines rigidly connected together and configured to reciprocate in phase with each other, the FPS machines of the first triad having axes of reciprocation that intersect a point that is spaced a finite distance from the machines, the axes being positioned at the apexes of a first equilateral triangle in a base plane that makes the same angle with each axis of reciprocation;

(b) a second opposed triad of three FPS machines that are identical to the machines of the first triad, rigidly connected to the machines of the first triad and configured to reciprocate in anti-phase with the machines of the first triad, the FPS machines of the second triad having their axes of reciprocation intersecting said point, and having their axes of reciprocation being positioned at the apexes of a second equilateral triangle in the base plane, the first equilateral triangle and the second equilateral triangle being concentric, having sides of identical length and being angularly offset so peripheral lines joining the apexes of the first and second equilateral triangles form a regular hexagon.

* * * * *